United States Patent [19]

Collier, Jr.

[11] Patent Number: 4,947,766

[45] Date of Patent: Aug. 14, 1990

[54] SAFE DEPOSIT BOX CONSTRUCTION

[76] Inventor: William S. Collier, Jr., 17 Lake Padgett Dr., Land of Lakes, Fla. 34639

[21] Appl. No.: 367,373

[22] Filed: Jun. 16, 1989

[51] Int. Cl.[5] ..... E05G 1/00

[52] U.S. Cl. ..... 109/56; 109/67

[58] Field of Search ..... 109/53, 56, 67, 74, 109/77, 79, 85; 312/111, 198, 199, 257.1

[56] References Cited

U.S. PATENT DOCUMENTS

| | | | |
|---|---|---|---|
| 712,139 | 10/1902 | Johnson | 49/168 |
| 1,623,652 | 4/1927 | Bang | 49/168 |
| 3,690,038 | 9/1972 | Dietrich | 49/489 |
| 3,841,727 | 10/1974 | Peng | 312/257.1 |
| 3,871,283 | 3/1975 | John | 109/56 |
| 4,114,319 | 9/1978 | Governale | 49/488 |
| 4,194,453 | 3/1980 | Cutter | 109/56 |
| 4,528,916 | 7/1985 | Knight | 109/56 |

*Primary Examiner*—Neill R. Wilson

*Attorney, Agent, or Firm*—Dominik, Stein, Saccocio, Reese, Colitz & Van Der Wall

[57] ABSTRACT

A safe deposit box construction including a two-dimensional array of safe deposit boxes, the doors of which are interconnectable with adjoining doors and the shelves of which are removable. The interconnectability of the doors and the removability of the shelves permit the intermediate shelf between adjoining boxes to be removed and the doors thereof interconnected to create a safe deposit box having a size equal to the combined sizes of the adjoining boxes.

10 Claims, 2 Drawing Sheets

SAFE DEPOSIT BOX CONSTRUCTION

BACKGROUND OF THE INVENTION

1. Field of the Invention

This invention relates to safe deposit boxes. More particularly, this invention relates to safe deposit box constructions having removable shelves and interconnectable doors allowing an intermediate shelf between adjoining boxes to be removed and the doors of the adjoining boxes interconnected to create an enlarged safe deposit box having the size of the combined boxes.

2. Description of the Background Art

Conventional safe deposit box constructions comprise a two dimensional array of safe deposit boxes which are manufactured together as a integral unit for sale to an institution such as a bank, savings and loan, or a private vault company. Each of the safe deposit boxes in the array is configured to slideably receive a bond box for safe storage of valuables.

It has long been recognized that is it desirable for the institution to have a mixture of various sized safe deposit boxes for rental to its customers at different rental rates. Hence, the array of safe deposit boxes may actually comprise a mixture of larger and smaller safe deposit boxes for rental to the customers. Unfortunately, it is often difficult or impossible for the institution to predict the customer demand for any particular size safe deposit box. Accordingly, an oversupply or an undersupply of a particular size of safe deposit boxes usually exists. The institution thus suffers customer dissatisfaction and loss of income.

In recent years, ganged safe deposit box constructions have been developed which include uniformly sized safe deposit boxes having removable shelves and interconnectable doors which allow an intermediate shelf between adjoining safe deposit boxes to be removed and the doors of the boxes interconnected to create a double-sized safe deposit box formed from the two adjoining boxes. Larger sized boxes (e.g. triple- & quadruple-sized) may be created by ganging additional adjoining boxes.

More specifically, U.S. Pat. No. 4,528,916 entitled "Plural Box Construction" discloses a ganged safe deposit box construction having removable shelves and interconnectable doors. In Patent '916, the intermediate shelves each include a down-turned front edge which is thicker than the crack between the adjacent doors of the adjoining boxes. The shelf, therefore, cannot be removed through the crack between adjacent doors and is retained in position between adjoining boxes by the closure of one or both of the adjacent doors. Conversely, both adjacent doors must be opened to allow removal of the shelf. To create a double-sized box, the adjacent doors are opened fully and the intermediate shelf between the adjoining boxes is removed. The adjacent doors are then interconnected by means of a spline which fits into a groove in the edges of the adjacent doors. A plate may be affixed to the adjacent doors to prevent spreading of the doors thereby retaining the spline in position therebetween. The interconnected doors thus function in the conventional manner as a single door to close about the enlarged safe deposit box, now comprised of the two adjoining boxes.

An object of this invention is to provide an improvement which is a significant contribution to the advancement of the safe deposit box art.

Another object of this invention is to provide an improved safe deposit box construction having removable shelves and interconnectable doors which allow an intermediate shelf between adjoining boxes to be removed and the adjacent doors interconnected to create a safe deposit box of a size equal to the combined areas of the adjoining boxes.

Another object of this invention is to provide an improved safe deposit box construction having easily removable shelves and easily interconnectable doors that can be quickly removed and interconnected with the use of a simple allen wrench.

Another object of this invention is to provide an improved safe deposit box construction which minimizes unnoticeable intrusion.

Another object of this invention is to provide an improved safe deposit box construction having removable shelves and interconnectable doors in which the shelves comprise a flat configuration thereby eliminating the need for any bending or other angle forming operations during the manufacture thereof.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a safe deposit box construction including a two dimensional array of safe deposit boxes. The doors of the safe deposit boxes are interconnectable with adjoining doors and the shelves in the safe deposit boxes are removable. The interconnectability of the doors and the removability of the shelves permit the intermediate shelf between adjoining boxes to be removed and the doors thereof interconnected to create a safe deposit having a size equal to the combined sizes of the adjoining boxes that were ganged. Moreover, any number of safe deposit boxes may be ganged together to create a new safe deposit box having a substantially increased size.

More particularly, the safe deposit box construction of the invention preferably comprises a two column section of safe deposit boxes constructed with a top and bottom wall, left and right outermost side walls and a middle wall positioned between the side walls thereby defining a two column box-like structure having an opened front. Uniquely designed slots and protrusions are formed equidistantly along the inner surfaces of the walls allowing a uniquely designed flat shelf to be quickly installed therein to create a two column array of equally sized safe deposit boxes. Equally sized safe deposit doors are hinged to the middle wall to open in a butterfly-like manner and to close about their respective safe deposit boxes. The edges of the doors are slotted for receiving a spline which allows adjacent doors to be interconnected.

An important feature of the safe deposit box construction of the invention is the uniquely designed slots and flat shelves which allow the shelves to be quickly installed therein. Each flat shelf includes a pair of flat arms protruding from the forwardmost side edges thereof. The flat arms are designed to slideably fit into the uniquely designed slots in the walls to secure the shelf into position while preventing spreading of the walls of the safe deposit box. The shelves are each secured into position by means of a retaining plate threadably secured to the face of the walls by means of an upper and lower screw, the upper screw of the lower shelf and the lower screw of the upper shelf being obstructed when the door for that safe deposit box is closed, thereby preventing removal of the shelf. Each flat shelf including its flat arms comprise a planar configuration facilitating manufacturing from flat stock material while eliminating any bending or special forming operations.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
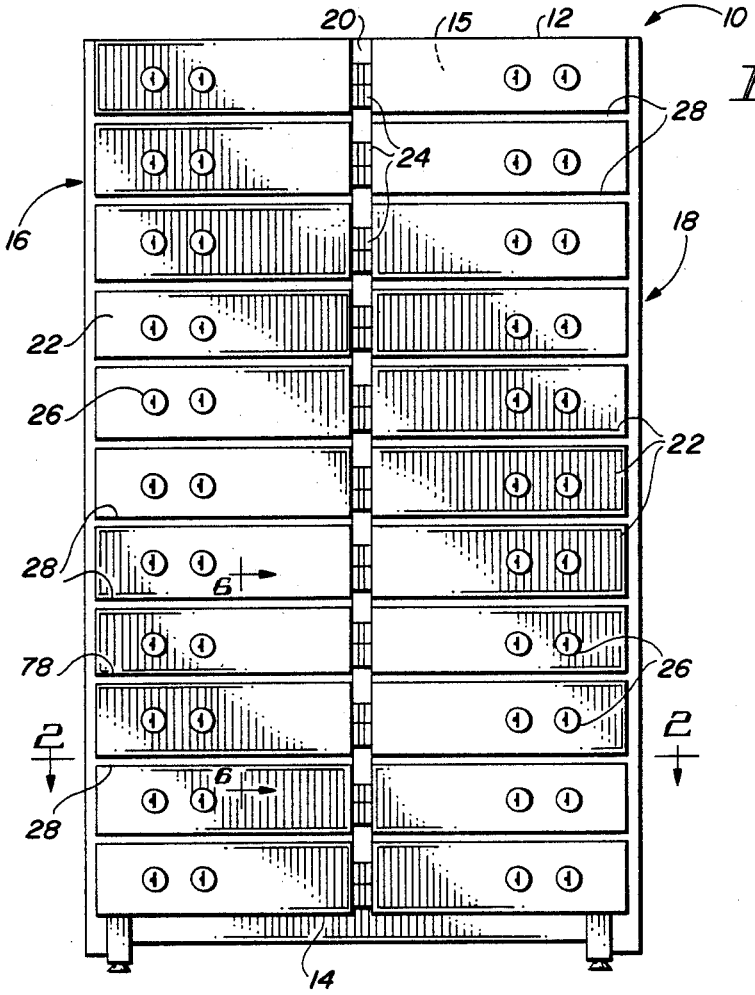
FIG. 1 is a front view of the two column safe deposit box construction of the invention illustrating uniformly sized safe deposit boxes and interconnectable doors which may be ganged together for creating larger sized safe deposit boxes.

Referring to FIG. 1, the safe deposit box construction 10 comprises top, bottom and rear walls 12, 14 and 15, left and right side walls 16 and 18 and middle wall 20, thereby defining a two column section having an open front.

Uniformly sized interconnectable doors 22 are hinged to the middle wall 20 by means of a conventional three-leaf butterfly safe deposit box hinge 24. Each door 22 is provided with a conventional double nose safe deposit box lock 26. Removable shelves 28 are provided for installation between adjacent doors 22 in each column to define individual safe deposit boxes. The interconnectable doors 22 and removable shelves 28 allow ganging of individual safe deposit boxes to create double, triple, quadruple, etc. sized boxes as desired.

For example, the individual safe deposit boxes may be dimensioned to have the interior dimensions of $3\frac{1}{4}''$ high$\times$10 5/32" wide$\times$$23\frac{3}{8}''$ long to receive a nominal three inch bond box having an actual size of $2\frac{3}{4}''$ high$\times$9 $\frac{3}{4}''$ wide$\times$22" long. To double the size of the safe deposit box, the intermediate shelf 28 is removed and the adjacent doors 22 are interconnected to increase the size of the new safe deposit box to 6 13/16" high$\times$10 5/32" wide$\times$$23\frac{3}{8}''$ long (taking into account the 12 gauge removed shelf) to receive a nominal five inch bond box having an actual height of $4\frac{3}{4}''$. Additional intermediate shelves 28 and adjacent doors 22 may be removed and interconnected to triple, quadruple, etc. to the size of the safe deposit box.

Figure 2:
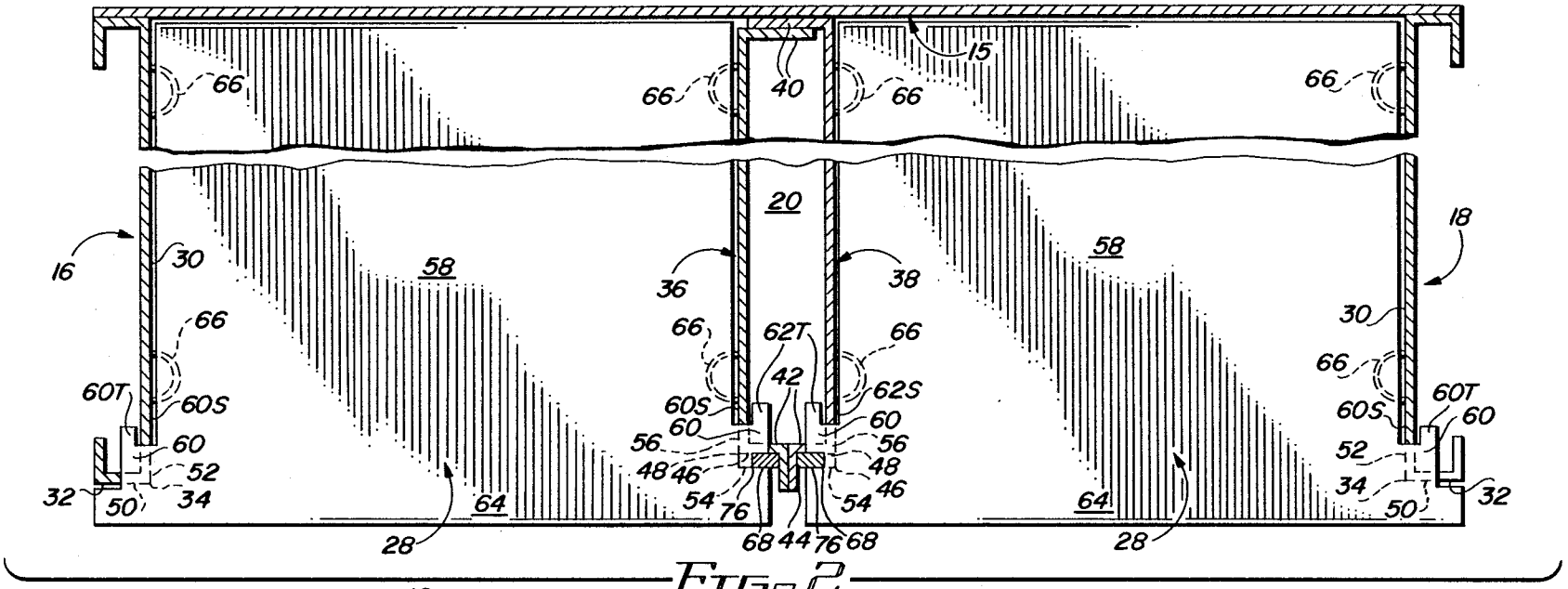
FIG. 2 is an enlarged, partial cross-sectional view of FIG. 1 illustrating the construction of the left and right and middle side walls creating the two column section for receiving removable shelves.

Referring to FIG. 2, the left and right side walls 16 and 18 are mirror images of each other and each include an inner side portion 30 and a face portion 32 defining a front corner 34. Similarly, middle wall 20 comprises left and right side portions 36 and 38 having their rear and front side edges 40 and 42 turned inwardly and welded together to create a double-walled construction. The front side edges 42 of the side portions 36 and 38 are further bent outwardly and welded to each another for creating a vertical hinge tang 44 to which the middle leaf of the hinge 24 is connected. As thus constructed, the inwardly turned front side edges 42 define a face portion 46 and a front corner 48.

Figure 3:
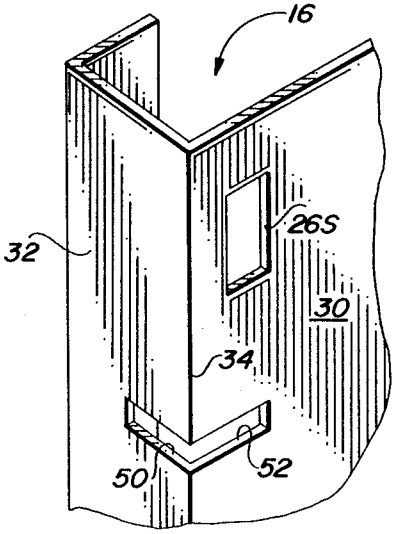
FIG. 3 is a perspective view of the left wall of the safe deposit box construction of the invention, the right wall being a mirror image thereof.

FIG. 3 is a partial perspective view of the left side wall 16 of the safe deposit box construction 10, the right side wall 18 being a mirror image thereof. As shown, a front slot 50 is formed from the front corner 34 into a part of the face portion 32. A side slot 52, in alignment with the front slot 50, is formed from the corner 48 into a part of the inner side portion 30. A slot 26S is provided for receiving the bolt of the lock 26. Alternatively, slot 26S may be provided with a removable plate allowing a conventional electronic safe deposit box lock to be utilized.

Figure 4:
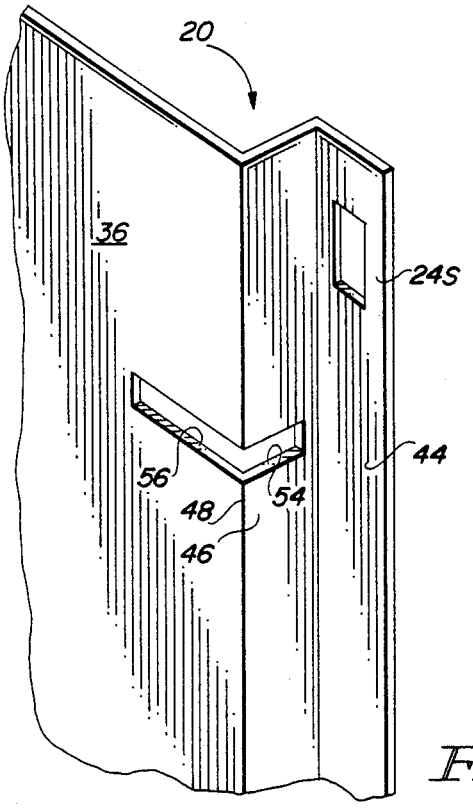
FIG. 4 is a perspective view of the middle wall illustrating the double-walled construction thereof, the right perspective view being a mirror image thereof.

FIG. 4 is a partial perspective view of the middle wall 20 illustrating the left wall portion 36 thereof, the right wall portion 38 being a mirror image thereof. As shown, a front slot 54 extends from corner 48 into a part of the face portion 46 and a side slot 56 which extends in alignment therewith from the corner 48 and to a part of the left wall portion 36. A slot 24S may be provided in tang 44 for receiving the tab of the hinge 24 that prevents removal of the door 22 in the event the hinge pin is removed.

Returning to FIG. 2, the removable shelves 28 of the invention each comprise a planar, substantially rectangular main portion 58, a pair of planar L-shaped arms 60 and 62 extending from the rectangular portion 58, and a planar, substantially T-shaped front portion 64 extending from the front edge of the shelf 58. The rectangular main portion 58 is dimensioned to fit between the side walls 16 (or 18) and middle wall 20 of the safe deposit box construction 10. The L-shaped arms 60 and 62 each include a rearwardly extending planar tab 60T and 62T, which defines a space 60S and 62S between the tab 60T and 62T and the main portion 58. During installation, tabs 60T and 62T engage into front and side slots 50 and 52 of the side wall 16 (or 18) and the front and side slots 54 and 56 of the middle wall 20, respectively. Slots 50–56 are aligned with the crack between adjacent doors 22 such that the T-shaped portion 64 of the shelf 28 fits into the crack between adjacent doors 22. This overlapping of the edges of the doors 22 provides stability to the doors 22 while preventing access to adjoining safe deposit boxes. Furthermore, the interlocking of the tabs 60T and 62T of the arms 60 and 62 with the respective slots 50–56 prevents spreading of the side wall 16 (or 18) and the middle wall 20. Finally, protrusions 66 are formed in the side wall 16 (or 18) and the middle wall 20 in the safe deposit box below the shelf 28 for support and at least one above the shelf to prevent the rear of the shelf 28 from being pushed up from the safe deposit box below. It is noted that the planar shelf 28 may be inverted and installed in the right column, between side wall 18 and middle wall 20.

Figure 5:
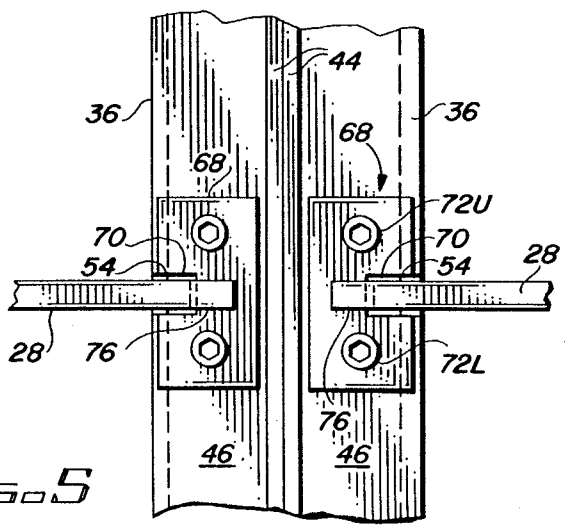
FIG. 5 is a front view of a retaining plate which secures the shelf into position.

As shown in FIG. 5, each shelf 28 is retained in position by means of a retaining plate 68. Specifically, retaining plate 68 comprises a generally rectangular configuration with center notch 70. Notch 70 of the retaining plate 68 is aligned with and engages into a corresponding notch 76 formed in the side edge of the shelf 28 between the arm 62T and the T-shaped end 64 (see also FIG. 2). Retaining plate 68 straddles the front slot 54 and is threadably connected to the face portion 46 of the wall portion 36 of the middle wall 20 by means of upper and lower allen head screws 72U and 72L which threadably engage into upper and lower Nutscrews (see FIG. 6) permanently secured in the face portion 46. The interlocking of notch 70 of retaining plate 68 with notch 76 of the shelf 28 prevents removal of the shelf even if one screw 72 is removed. Furthermore, it is noted that the head of the upper and lower screws 72U and 72L are covered by the upper and lower adjacent doors 22 when such doors 22 are closed. Thus, both adjacent doors 22 must be opened before both screws 72U and 72L can be unthreaded and the retaining plate 68 and intermediate shelf 28 removed.

Figure 6:
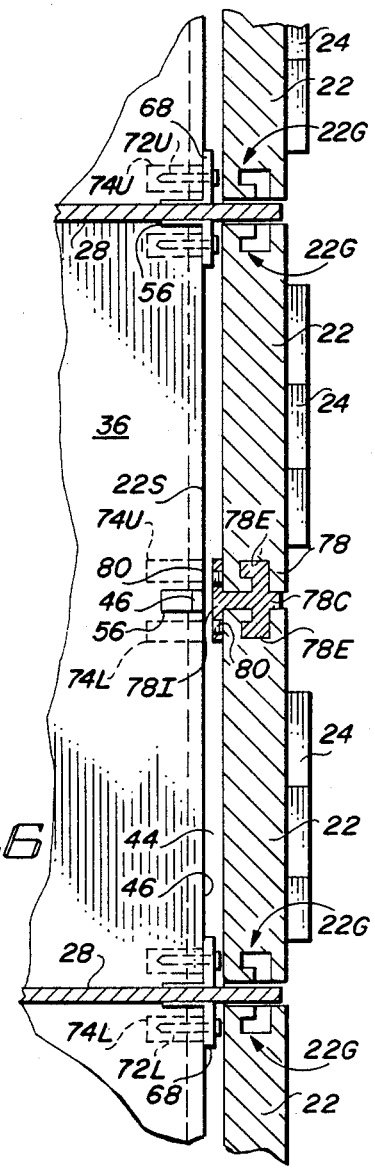
FIG. 6 is a partial vertical cross-sectional view of FIG. 2 illustrating two interconnected doors creating a double-sized safe deposit box.

As shown in FIG. 6, the adjacent doors may be interconnected by means of a spline 78 which fits into corresponding grooves 22G formed in the horizontal edges of the doors 22. Preferably grooves 22G are L-shaped in cross-section for receiving a spline 78 having L-shaped ends 78E. Furthermore, spline 78 preferably comprises a center portion 78C which fits between the crack of adjacent doors 22. The spline 78 further preferably comprises a substantially flat innerportion 78I which extends along the length of the spline 78 adjacent the inside surface 22S of the doors 22. Spline 78 is preferably secured into position by means of an allen head set screw 80 which threadably engages through the inner portion 78I for frictional engagement with the respective door 22.

The spline 78 as thus configured is easily installed in the grooves 22G of adjacent doors 22 to rigidly interconnect the same. Spreading of the doors 22 is prevented because of the L-shaped grooves 22G and the corresponding L-shaped ends 78E of the spline 78. Ideally, the allen head of the set screws 80 and the screw 72 of the retaining plate 68 are of the same size as the allen head of the key adjustment of the lock 26 such that only one allen wrench is needed for keying the lock, installing or removing the shelves 28, and interconnecting the doors 22 with the spline 78.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described,

What is claimed is:

1. A safe deposit box construction, comprising in combination:

top wall, bottom wall, rear wall, and left and right side walls joined together to define a substantially rectangular construction having an opened front, said side walls including paired slots in a front portion of said side walls, said front portion of said side walls each comprising a face portion and a side portion in which said slot is positioned;

a plurality of removable shelves for insertion between said side walls which define a plurality of boxes, a side portion of said shelves engaging into said side paired slots in said side wall, said side portion of said shelves which engages into said slots comprising a pair of arms which engages into said slots in said face portion and said side portion;

means for removably securing said shelves between said side walls;

a plurality of doors hingely connected to one of said side walls for closure about said opened front, said doors including a lock for engaging the other of said side walls; and means for interconnecting adjacent said doors, wherein, one of said shelves between adjoining said boxes may be removed and adjacent said doors thereof interconnected to create a box of a size equal to the adjoining boxes.

2. The safe deposit box construction as set forth in claim 1, wherein said shelves are planar.

3. The safe deposit box construction as set forth in claim 1, wherein two of said substantially rectangular constructions are combined to create a two column array of safe deposit boxes with a left and right side walls divided by a doubled walled middle wall and wherein said doors are hingely connected to said middle wall.

4. The safe deposit box construction as set forth in claim 1, wherein said interconnecting means comprises a spline which engages into aligned slots formed in mating edges of said doors.

5. The safe deposit box construction as set forth in claim 4, wherein said spline and said slots in said doors are substantially L-shaped in cross-section to prevent spreading of interconnected said doors.

6. The safe deposit box construction as set forth in claim 1, wherein said arms of said shelves each include a rearwardly extending tab portion which prevents spreading of said side walls when said shelves are inserted therebetween.

7. The safe deposit box construction as set forth in claim 6, wherein said slots are aligned between adjacent said doors and wherein said shelves each include a front T-shaped portion which extends between adjacent said doors when closed and which extends in front of said face portions of said side walls.

8. The safe deposit box construction as set forth in claim 1, wherein said securing means comprises a retaining plate which straddles one of said arm portions of each said shelf when positioned adjacent to said face portion of said shelf and fastener means which removably fastens said retaining plate to said face portion.

9. The safe deposit box construction as set forth in claim 8, wherein said fastener means comprises a threaded fastener.

10. The safe deposit box construction as set forth in claim 8, wherein said retaining plate and said side portions of said shelves aligned with said retaining plate each include a slot which engage each other.

* * * * *

UNITED STATES PATENT AND TRADEMARK OFFICE

CERTIFICATE OF CORRECTION

PATENT NO. : 4,947,766

DATED : August 14, 1990

INVENTOR(S) : William S. Collier, Jr.

It is certified that error appears in the above—identified patent and that said Letters Patent is hereby corrected as shown below:

Column 6, line 40, please delete "wherein" and insert therefor --whereby--.

Signed and Sealed this

Nineteenth Day of November, 1991

*Attest:*

HARRY F. MANBECK, JR.

*Attesting Officer*

*Commissioner of Patents and Trademarks*